US011131306B2

(12) United States Patent
Obrist et al.

(10) Patent No.: US 11,131,306 B2
(45) Date of Patent: Sep. 28, 2021

(54) DISPLACEMENT MACHINE INCLUDING ONLY ONE DISPLACEMENT SPIRAL PASSAGE AND GAS CONNECTION LINE IN COMMUNICATION WITH A COUNTER PRESSURE CHAMBER

(71) Applicant: OET GmbH, Lustenau (AT)

(72) Inventors: Frank Obrist, Bregenz (AT); Christian Schmälzte, Lauterach (AT); Christian Busch, Feldkirch (AT)

(73) Assignee: OET GmbH, Lustenau (AT)

( * ) Notice: Subject to any disclaimer, the term of this patent is extended or adjusted under 35 U.S.C. 154(b) by 526 days.

(21) Appl. No.: 15/934,476

(22) Filed: Mar. 23, 2018

(65) Prior Publication Data

US 2018/0335032 A1 Nov. 22, 2018

(30) Foreign Application Priority Data

May 19, 2017 (DE) ..... DE10 2017 110 913.7

(51) Int. Cl.
*F04C 18/02* (2006.01)

(52) U.S. Cl.
CPC ..... *F04C 18/0261* (2013.01); *F04C 18/0215* (2013.01)

(58) Field of Classification Search
CPC ..... F04C 18/0215; F04C 18/0261; F04C 27/005; F04C 29/0007; F04C 29/0035;
(Continued)

(56) References Cited

U.S. PATENT DOCUMENTS 5,462,418 A 10/1995 Shimizu et al.
5,762,483 A 6/1998 Lifson et al.
(Continued)

FOREIGN PATENT DOCUMENTS

CN 1378620 A 11/2002
CN 1323227 A 3/2006
(Continued)

OTHER PUBLICATIONS

English Machine Translation of KR101355114(B1) translated on Jun. 13, 2020 by Espacenet (Year: 2014).*
(Continued)

*Primary Examiner* — Mary Davis
*Assistant Examiner* — Paul W Thiede
(74) *Attorney, Agent, or Firm* — Schwegman Lundberg & Woessner, P.A.

(57) ABSTRACT

The invention relates to a displacement machine according to the spiral principle, in particular a scroll compressor, with a high-pressure zone which comprises a high-pressure chamber, with a low-pressure chamber and with an orbiting displacement spiral, which engages into a counter spiral such that between the displacement spiral and the counter spiral compression chambers are formed, in order to receive a working medium, wherein between the low-pressure chamber and the displacement spiral a counter pressure chamber is formed. According to the invention, the displacement spiral has only one passage, which at least temporarily produces a fluid connection between the counter pressure chamber and at least one of the compression chambers, wherein the passage is formed in such a portion of the displacement spiral in which the passage in the activated state of the displacement machine is opened on reaching of 85%-100%, in particular of 90%-100%, in particular of 95%, of the relative compression chamber volume, and remains opened during a subsequent rotation, after opening, of the displacement spiral about a rotational angle of 120°-360°, in particular of 255°-315°, in particular of 270°.

10 Claims, 5 Drawing Sheets

(58) Field of Classification Search
CPC .. F04C 29/02; F04C 18/0253; F04C 18/0292; F04C 29/02; F04C 29/0021
USPC ..... 418/55.1, 55.2, 55.3, 55.4, 55.5, 55.6
See application file for complete search history.

(56) References Cited

U.S. PATENT DOCUMENTS

| | | | | |
|---|---|---|---|---|
| 6,231,316 | B1 | 5/2001 | Wakisaka et al. | |
| 6,301,912 | B1 | 10/2001 | Terai et al. | |
| 7,699,589 | B2 | 4/2010 | Terauchi et al. | |
| 9,512,840 | B2 | 12/2016 | Obrist et al. | |
| 10,094,379 | B2 | 10/2018 | Won et al. | |
| 10,527,041 | B2 * | 1/2020 | Moon | F04C 29/028 |
| 10,801,496 | B2 * | 10/2020 | Obrist | F04C 18/0215 |
| 2003/0074905 | A1 | 4/2003 | Taira | |
| 2006/0254309 | A1 | 11/2006 | Takeuchi et al. | |
| 2008/0038133 | A1 | 2/2008 | Sawai et al. | |
| 2010/0158710 | A1 | 6/2010 | Umemura et al. | |
| 2012/0230854 | A1 | 9/2012 | Chikano et al. | |
| 2013/0216416 | A1 | 8/2013 | Takeda et al. | |
| 2013/0280115 | A1 * | 10/2013 | Kawamura | F04C 18/0215 418/55.1 |
| 2014/0348679 | A1 | 11/2014 | Ignatiev et al. | |
| 2014/0348681 | A1 | 11/2014 | Obrist et al. | |
| 2015/0260189 | A1 | 9/2015 | Kato | |
| 2016/0177953 | A1 * | 6/2016 | Sun | F04C 18/0261 418/55.1 |
| 2018/0255961 | A1 | 9/2018 | Vetterli et al. | |
| 2018/0258933 | A1 * | 9/2018 | Obrist | F04C 18/0215 |
| 2019/0072094 | A1 | 3/2019 | Lässer et al. | |

FOREIGN PATENT DOCUMENTS

| | | | |
|---|---|---|---|
| CN | 101052307 | A | 10/2007 |
| CN | 101297117 | A | 10/2008 |
| CN | 101761478 | A | 6/2010 |
| CN | 102297132 | A | 12/2011 |
| CN | 102788016 | A | 11/2012 |
| CN | 104105381 | A | 10/2014 |
| CN | 104179682 | A | 12/2014 |
| CN | 105026763 | A | 11/2015 |
| DE | 10147339 | A1 | 5/2002 |
| DE | 112005002722 | | 12/2007 |
| DE | 102013020762 | | 6/2015 |
| DE | 102013021250 | | 6/2015 |
| EP | 2479435 | A1 | 7/2012 |
| EP | 2806164 | | 11/2014 |
| JP | S58190591 | U | 11/1983 |
| JP | S618407 | Y2 | 1/1986 |
| JP | S611169686 | | 7/1986 |
| JP | H01271680 | A | 10/1989 |
| JP | H03258985 | A | 11/1991 |
| JP | H06159270 | A | 6/1994 |
| JP | 2005-140016 | A | 6/2005 |
| JP | 2006-214379 | A | 8/2006 |
| JP | 2010-150967 | A | 7/2010 |
| JP | 2010-185299 | A | 8/2010 |
| JP | 2011064189 | A | 3/2011 |
| JP | 2013234666 | A | 11/2013 |
| JP | 2013-249733 | A | 12/2013 |
| JP | 2014-228002 | A | 12/2014 |
| KR | 10-1998-0070887 | A | 10/1998 |
| KR | 20100017006 | A | 2/2010 |
| KR | 101344114 | B1 * | 12/2013 |
| KR | 10-1355114 | B1 | 1/2014 |
| WO | WO-2009/017157 | A1 | 2/2009 |
| WO | WO-2016190490 | A1 | 12/2016 |
| WO | WO-2017/085256 | A1 | 5/2017 |

OTHER PUBLICATIONS

"Korean Application Serial No. 10-2018-0037220, Office Action dated Jul. 17, 2019", (w/English Translation), 14 pgs.
"European Application No. 18167002.7, Extended European Search Report dated Oct. 8, 2018", (Oct. 8, 2018), 7 pgs.
"Japanese Application No. 2018-054630, Notice of Reasons for Rejection dated Jul. 9, 2019", (Jul. 9, 2019), 5 pgs.
"U.S. Appl. No. 15/777,357, Final Office Action dated Jan. 6, 2021", 13 pgs.
"U.S. Appl. No. 15/777,357, Non-Final Office Action dated Aug. 7, 2020", 21 pgs.
"U.S. Appl. No. 15/777,357, Response filed Apr. 6, 2021 to Final Office Action dated Jan. 6, 2021", 9 pgs.
"U.S. Appl. No. 15/777,357, Response filed Jul. 13, 2020 to Restriction Requirement dated May 13, 2020", 10 pgs.
"U.S. Appl. No. 15/777,357, Response filed Nov. 9, 2020 to Non-Final Office Action dated Aug. 7, 2020", 12 pgs.
"U.S. Appl. No. 15/777,357, Restriction Requirement dated May 13, 2020", 5 pgs.
"U.S. Appl. No. 15/777,357, Preliminary Amendment filed May 18, 2018", 10 pgs.
"Chinese Application No. 201680059981.4, First Office Action dated Nov. 5, 2018", (w/ English Translation), (Nov. 5, 2013), 11 pgs.
"Chinese Application No. 201680059981.4, Second Office Action dated Jul. 10, 2019", (w/ English Translation), (Jul. 10, 2019), 25 pgs.
"German Application 10 2015 120 151.8, German Search Report dated Sep. 28, 2016", (w/ Concise Statement of Relevance), 11 pgs.
"International Application No. PCT/EP2016/078141, International Preliminary Report on Patentability dated May 31, 2013", 9 pgs.
"International Application No. PCT/EP2016/078141, International Search Report and Written Opinion dated Jan. 10, 2017", 11 pgs.
"Japanese Application No. 2018-518680, Notice of Reasons for Rejection dated May 28, 2019", (w/ English Translation), (May 28, 2019), 11 pgs.
"Japanese Application No. 2018-518680, Written Opinion and Amendment filed Aug. 26, 2019 in response to Notice of Reasons for Rejection dated May 28, 2019", (w/ English Translation), 20 pgs.
"Korean Application Serial No. 10-2018-0037220, Written Opinion and Amendment filed Sep. 17, 2019 in response to Office Action dated Jul. 17, 2019", (w/ English Translation), 24 pgs.
"Machine Translation of DE102013021250", <https://translationportal.epo.org/>, (2020), 8 pgs.
"Chinese Application No. 201810447978.0, First Office Action and Search Report dated Mar. 31, 2021", (Mar. 31, 2021), 9 pgs.
U.S. Appl. No. 15/777,357, filed May 18, 2018, Displacement Machine According to the Spiral Principle, Method to Regulate Pressure in the Counter-Pressure Chamber by Using a Pressure Difference and Characteristic Curve.

* cited by examiner

DISPLACEMENT MACHINE INCLUDING ONLY ONE DISPLACEMENT SPIRAL PASSAGE AND GAS CONNECTION LINE IN COMMUNICATION WITH A COUNTER PRESSURE CHAMBER

CLAIM OF PRIORITY

This application claims the benefit of priority of German Application Serial No. 10 2017 110 913.7, filed May 19, 2017, entitled "Verdrängermaschine nach dem Spiralprinzip, Verfahren zum Betreiben einer Verdrängermaschine, Fahrzeugklimaanlage und Fahrzeug" which is incorporated herein by reference in its entirety.

The invention relates to a displacement machine according to the spiral principle, in particular a scroll compressor, with a high-pressure zone which comprises a high-pressure chamber, furthermore with a low-pressure chamber and with an orbiting displacement spiral, which engages into a counter spiral such that compression chambers are formed between the displacement spiral and the counter spiral, in order to receive a working medium, wherein between the low-pressure chamber and the displacement spiral a counter pressure chamber is formed. Furthermore, the invention relates to a method for operating a displacement machine. In addition, the invention relates to a vehicle air-conditioning system and a vehicle with a displacement machine according to the invention.

BACKGROUND OF THE INVENTION

Scroll compressors and/or scroll expanders are sufficiently known from the prior art. These comprise a high-pressure chamber, a low-pressure chamber and an orbiting displacement spiral. The orbiting displacement spiral, as illustrated for example in EP 2 806 164 A1, engages into a counter spiral such that between the displacement spiral and the counter spiral compression chambers are formed in order to receive a working medium. A receiving space, namely a counter pressure chamber, is formed between the low-pressure chamber and the displacement spiral. Such a counter pressure chamber is also known under the term back pressure space. By means of the counter pressure chamber or respectively by means of the back pressure space, it is possible to build up a pressure which acts on the orbiting displacement spiral. A resulting force occurs in axial direction, whereby the displacement spiral is pressed against the counter spiral and therefore the spirals are sealed with respect to one another.

SUMMARY OF THE INVENTION

The invention is based on the problem of further developing a displacement machine according to the spiral principle such that the pressure in the counter pressure chamber is able to be adjusted itself in an advantageous manner. A variable back pressure system or respectively a variable counter pressure system is to be provided, wherein the pressure in the counter pressure chamber is able to be adjusted on the basis of different operating pressures. In particular, the displacement machine is to be further developed such that the risk of contamination by impurities in the refrigerant is reduced. The displacement machine is to be configured here in a structurally simple manner.

Furthermore, the invention is based on the problem of indicating a further developed method for operating a displacement machine. In addition, the problem consists in indicating a vehicle air-conditioning system and/or a vehicle with a further developed displacement machine according to the spiral principle.

In accordance with the invention, this problem is solved with regard to the displacement machine according to the spiral principle, with regard to the method for operating a displacement machine, with regard to the vehicle air-conditioning system and with regard to the vehicle by the subject matter of the various claims.

Advantageous and expedient embodiments of the displacement machine according to the spiral principle, in accordance with the invention, and/or of the method in accordance with the invention for operating a displacement machine are indicated in the subclaims.

The invention is based on the idea of indicating a displacement machine according to the spiral principle, in particular a scroll compressor, with a high-pressure zone which comprises a high-pressure chamber, with a low-pressure chamber and with an orbiting displacement spiral which engages into a counter spiral such that compression chambers are formed between the displacement spiral and the counter spiral in order to receive a working medium. Between the low-pressure chamber and the displacement spiral a counter pressure chamber or respectively a so-called back pressure space is formed.

According to the invention, the displacement spiral has only one passage, which establishes at least temporarily a fluid connection between the counter pressure chamber and at least one of the compression chambers, wherein the passage is formed in such a portion of the displacement spiral by the passage in the activated state of the displacement spiral being opened on reaching of 85%-100%, in particular of 90%-100%, in particular of 95%, of the relative compression chamber volume, and remaining open during a subsequent rotation of the displacement spiral, after opening, about a rotational angle of 120°-360°, in particular of 255°-315°, in particular of 270°.

The formation of only one passage or respectively of a single passage in the displacement spiral brings about a temporary fluid connection or respectively gas connection between at least one of the compression chambers and the counter pressure chamber. Due to this, a back pressure system or respectively a counter pressure system can be made available, wherein the pressure in the counter pressure chamber is able to be adjusted as a function of the high pressure and of the prevailing pressure in at least one compression chamber.

Preferably, the counter spiral is incorporated completely securely into the displacement machine. In other words, the counter spiral is therefore also not movable in axial direction. The displacement spiral is movable in axial direction relative to the counter spiral. Therefore, the orbiting displacement spiral can be additionally movable in axial direction. Here, the displacement spiral can be moved in the direction of the counter spiral and away from the counter spiral.

A contact pressure acting from the displacement spiral onto the counter spiral in axial direction is able to be adjusted by the described pressure prevailing in the counter pressure chamber. In other words, the force acting from the displacement spiral in axial direction onto the counter spiral is preferably brought about by the pressure prevailing in the counter pressure chamber. Depending on the pressure prevailing in the counter pressure chamber, a contact pressure acting from the displacement spiral onto the counter spiral in axial direction can be adjusted.

The displacement spiral preferably always acts with a certain contact pressure onto the counter spiral, so that the tightness of the arrangement of the two spirals is guaranteed. The contact pressure onto the counter spiral is preferably adjusted such that no higher contact pressure acts on the counter spiral than is necessary for the tightness at the current operating point (operating pressures/rotation speed) of the compressor. An increased contact pressure in this respect would lead to output losses in the displacement machine.

Between the displacement spiral and the counter spiral, radially inwardly travelling compression chambers are formed, in order to receive, compress a working medium, in particular a refrigerant, and expel it into the high-pressure chamber. In accordance with this embodiment of the invention, the displacement machine operates in particular as a scroll compressor. In other words, the displacement machine is a scroll compressor.

The only one, or respectively single, passage of the displacement spiral is preferably formed in a portion of the base of the displacement spiral. This means that the passage is in particular not formed in the spiral flank portions of the displacement spiral.

The only one, or respectively single, passage is preferably configured as a passage formed substantially perpendicularly with respect to the base of the displacement spiral. This passage is preferably a bore.

For example, the passage is formed centrally between two flank portions. Furthermore, it is possible that the passage is arranged eccentrically in relation to two flank portions.

The passage is formed in such a portion, in particular in such a base portion, of the displacement spiral, by the passage in the activated state of the displacement machine being opened on reaching of 85%-100%, in particular of 90% to 100%, in particular 95%, of the relative compressure chamber volume, and remaining open during a subsequent rotation of the displacement spiral, after opening, about a rotational angle of 180°-360°, in particular of 255°-315°, in particular of 270°. In other words, after opening of the first passage, the displacement spiral can be rotated through a further 180°-360°, in particular through a further 255°-315°, in particular through a further 270°, while the passage remains open. An open state of the passage describes that the passage is not covered by the counter spiral, in particular not by the spiral element or respectively by a spiral flank portion of the counter spiral.

Owing to the configuration of the displacement spiral in accordance with the invention, in particular of the only one single passage in the displacement spiral, a connection from the counter pressure chamber to the low-pressure chamber can be dispensed with. In other words, the counter pressure chamber is not fluidly connected with the low-pressure chamber.

The contamination risk through impurities in the refrigerant is considerably reduced, because the fluid, in particular the mass flow, is moved to and fro or respectively flows to and fro in the single passage. Owing to this, impurities in this passage are eliminated more quickly and more easily.

As only one connection or respectively one passage is formed from at least one compression chamber to the counter pressure chamber, the pressure in the counter pressure can be easily adjusted. The pressure prevailing in the counter chamber is able to be formed owing to a mass flow flowing from the high-pressure zone into the counter chamber and owing to a mass flow flowing from one of the compression chambers into the counter chamber. In other words, the formation of the pressure prevailing in the counter chamber occurs owing to a combination of the mass flow, which flows from the high-pressure zone into the counter chamber, with the mass flow which flows from one of the compression chambers into the counter chamber.

It is possible that the passage is open with a rotational angle of the displacement machine of 25°-315°, in particular of 30°-310°, in particular of 35°-305°. The first even numbers of the indicated ranges always relate to the angle of the displacement machine which is present at the opening process of the passage. The last even numbers of the indicated ranges always relate to the angle of the displacement machine which is present (approximately) at a closing process of the passage.

The 0° angle of the displacement machine describes the start of the compression between the displacement spiral and the counter spiral. The 0° angle of the displacement machine describes the state at which one of the at least two compression chambers is closed.

In other words, the only one or respectively single passage is formed in such a portion of the displacement spiral that above-mentioned conditions with regard to the opening or respectively opening moment and the closing or respectively closing moment can be achieved. Depending on the size of the displacement machine, therefore different geometric configurations can be constructed with regard to the arrangement of the passage. For the named conditions with regard to the moments of opening and closing of the passages, however, what is mentioned above applies for all displacement machines which are to be constructed.

Preferably, the passage is closed at least at a rotational angle of 10°, in particular of at least 20°, in particular of at least 30°, before reaching the so-called discharge angle. The discharge angle describes the rotational angle at which the gas, compressed in the compression chambers, has been sufficiently discharged into the high-pressure chamber and the pressure in the compression chamber decreases abruptly accordingly. In other words, before reaching the discharge angle, in particular at least 10° before reaching the discharge angle, in particular at least 20° before reaching the discharge angle, in particular at least 30° before reaching the discharge angle, the passage is closed. This means that compressed gas which is present in the compression chambers, but has not been discharged into the high-pressure chamber, remains in the compression chamber. This remaining compressed gas, which has not been discharged or respectively expelled, can not therefore arrive into the counter pressure chamber or respectively not into the back pressure space. Therefore, the passage is to be closed in good time before reaching the discharge angle.

The back pressure or respectively counter pressure is in fact always higher than the counteracting axial force owing to the compressed high pressures prevailing in the compression chambers, however the pressure of the back pressure can be adjusted less in different operating phases than is the case with conventional displacement machines, so that by means of the displacement machine according to the invention an effective compression process can be realized.

In the activated state of the displacement machine, i.e. with an orbiting movement of the displacement spiral in the counter spiral, a plurality of compression chambers are formed, the space of which becomes smaller from the outer radial circumference of the displacement spiral towards the centre, so that the refrigerant gas received at the circumference is compressed. The compression final pressure is achieved in the axial region of the displacement spiral, in particular in the central portion of the displacement spiral, and the refrigerant gas is released axially when high pressure is reached. For this, the counter spiral has an opening, so that a fluid connection is formed to the high-pressure zone, in particular to the high-pressure chamber.

The temporary fluid connection between the counter-pressure chamber and at least one of the compression chambers is made possible through the arrangement of the passage and the orbiting movement of the displacement spiral.

Furthermore, it is possible that the displacement machine is configured such that a gas connection line is formed from the high-pressure zone of the displacement machine to the counter pressure chamber. For example, the gas connection line is formed from the high-pressure chamber to the counter pressure chamber. The gas connection line can be formed in the counter spiral and can connect the high-pressure chamber with the counter pressure chamber. In a further embodiment of the invention, the gas connection line can be formed in the housing of the displacement machine.

Furthermore, proceeding from the high-pressure zone of the displacement machine to the low-pressure chamber, an oil return duct can be formed. Therefore, a separation of the oil flow can be realized from the refrigerant gas flow within the compression process. In other words, the oil return duct is preferably separated form the gas connection line.

The coolant is drawn in in the start region of the spiral and is conveyed or respectively transported only in the direction of the compression process between the two spirals, i.e. between the displacement spiral and the counter spiral. The mass flow can not arrive from the counter pressure chamber into the low-pressure zone, in particular not into the low-pressure chamber. Because of this, a variable back pressure system or respectively a variable counter pressure system can be made available.

The displacement machine according to the invention can be configured as an electrically and/or electromotively driven displacement machine, or as a displacement machine with mechanical drive.

A further aspect of the invention relates to a method for operating a displacement machine according to the invention. The method is based on the fact that the passage is opened on reaching of 85%-100%, in particular of 90%-100%, in particular of 95%, of the relative compression chamber volume, and remains open during a subsequent rotation, after opening, of the displacement spiral about a rotational angle of 120°-360°, in particular of 255°-315°, in particular of 270°.

Preferably, the pressure prevailing in the counter chamber is formed owing to a mass flow flowing from the high-pressure zone into the counter chamber and owing to a mass flow flowing from one of the compression chambers into the counter chamber.

With regard to further embodiments of the method according to the invention, reference is made to previous explanations, in particular to the explanations in connection with the opening and/or closing moments or respectively the opening duration of the passage. Similar advantages result as are already indicated in connection with the displacement machine according to the invention.

A further coordinate aspect of the invention relates to a vehicle air-conditioning system with a displacement machine according to the invention, in particular with a scroll compressor according to the invention. Similar advantages result as are already indicated in connection with the displacement machine according to the invention.

A further coordinate aspect of the invention relates to a vehicle, in particular a hybrid vehicle, with a displacement machine according to the invention and/or with a vehicle air-conditioning system according to the invention. Similar advantages occur as are already indicated in connection with the displacement machine according to the invention. In particular, the vehicle according to the invention concerns an electric hybrid vehicle.

BRIEF DESCRIPTION OF THE DRAWINGS

The invention is explained in further detail in the following, with the aid of example embodiments with reference to the enclosed diagrammatic drawings.

There are shown therein:

FIG. 7 is an illustration of expulsion cycles from the compression chamber into the high-pressure chamber and illustration of the opening phases of the passage in connection with the refrigerant R134a.

DETAILED DESCRIPTION

In the following, the same reference numbers are used for identical parts and parts which have an identical effect.

Figure 1:
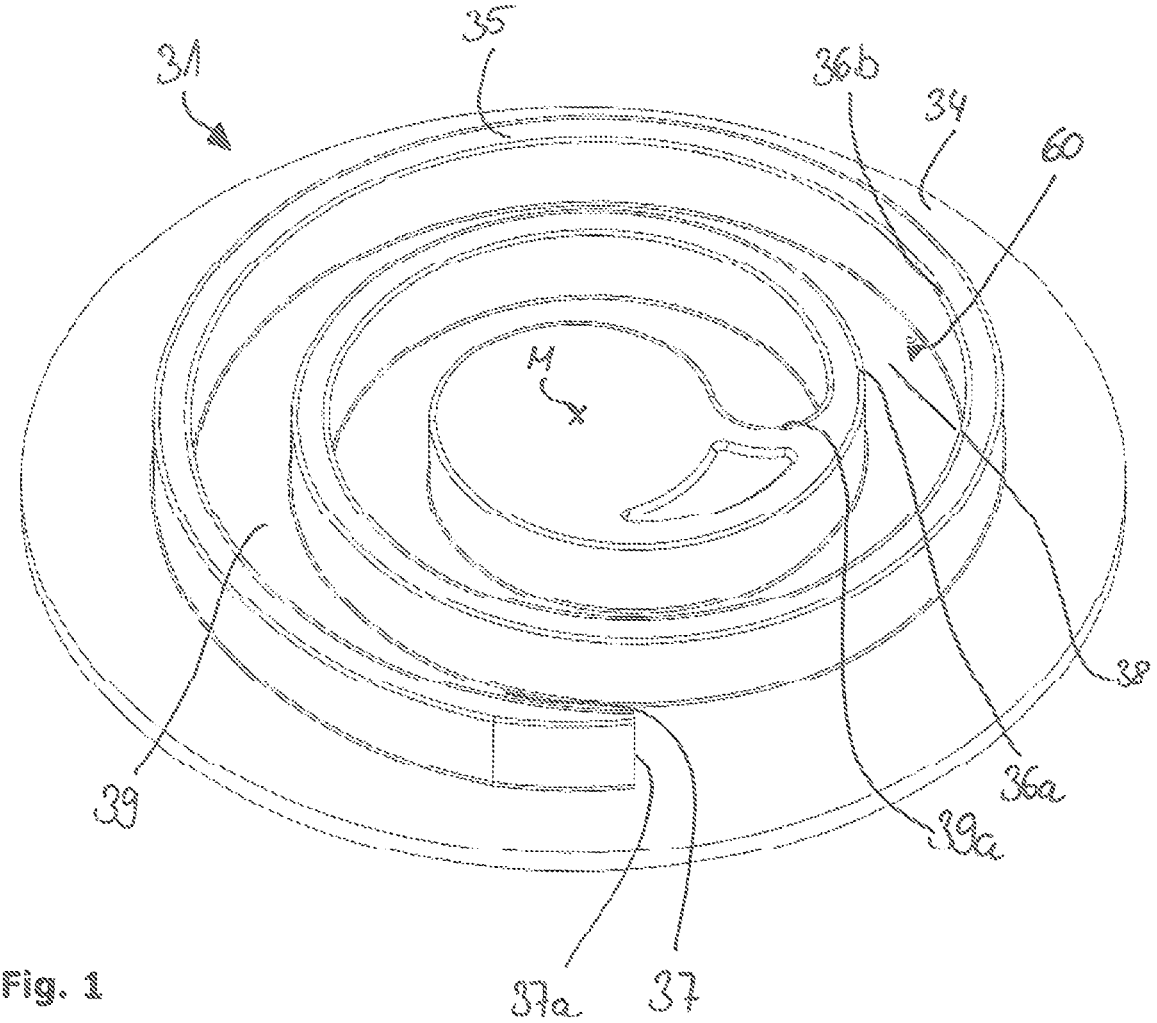
FIG. 1 is a displacement spiral of a displacement machine according to the invention, in a perspective top view.

In FIG. 1, a displacement spiral 31 is illustrated, as can be incorporated in a displacement machine according to the invention. In particular, the displacement spiral 31 serves for incorporation into a scroll compressor 10, as can be constructed for example in accordance with the example embodiment of FIG. 2.

As illustrated in FIG. 1, the displacement spiral 31 comprises a base 34. The base 34 can also be designated as a rear wall of the displacement spiral 31. The base 34 is configured so as to be circular and has the form of a round plate. A spiral 35 with spiral flank portions 36*a* and 36*b* is formed on the base 34.

The spiral element 35 extends, proceeding from the midpoint M of the displacement spiral 31, up to a start region 37.

In the base 34, a passage 60 is formed. The passage 60 concerns a through-bore which runs substantially perpendicularly to the surface of the base 34. The passage 60 is formed here in a central portion 38 of the displacement spiral 31. The passage 60 is formed in a portion of the base 34, wherein the passage 60 is formed eccentrically between the spiral flank portions 36*a* and 36*b*. The overall length of the spiral passage 39 is defined proceeding from the opening 37*a* up to the end portion 39*a* of the spiral passage 39. The end portion 39*a* is the last portion of the spiral passage 39 in the direction of flow of the refrigerant. In the illustrated example, the end portion 39*a* is configured in a curved manner.

Figure 2:
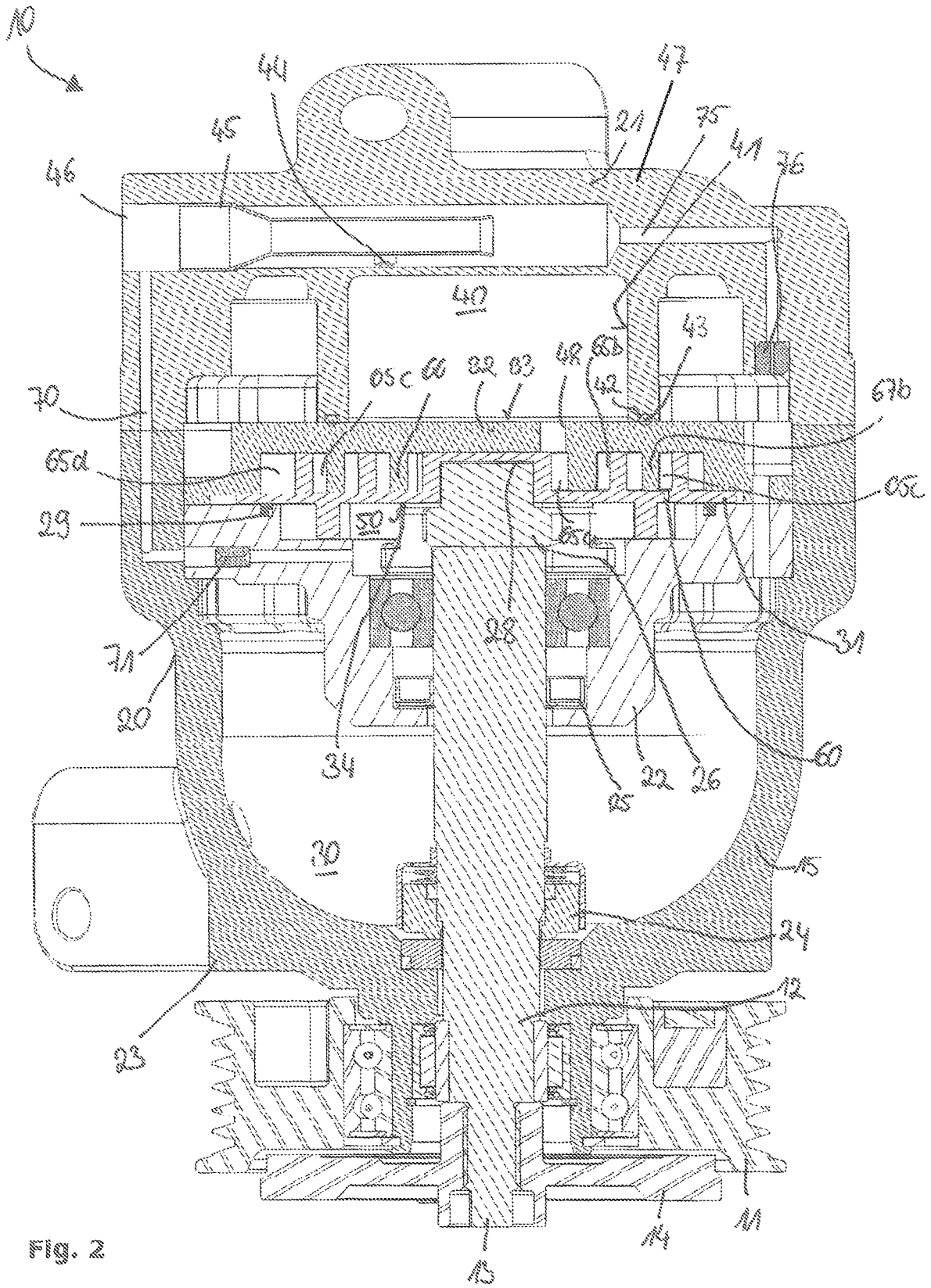
FIG. 2 is a longitudinal section of a displacement machine according to the invention, in particular of a scroll compressor.

The displacement spiral 31 illustrated according to FIG. 1 is incorporated into the scroll compressor 10 in accordance with the example embodiment of FIG. 2. This scroll compressor 10 can act, for example, as a compressor of a vehicle air-conditioning system. A vehicle air-conditioning system, such as e.g. a $CO_2$ vehicle air-conditioning system, typically has a gas cooler, an inner heat exchanger, a throttle, an evaporator and a compressor. The compressor can be accordingly the illustrated scroll compressor 10. In other words, the scroll compressor 10 concerns a displacement machine according to the spiral principle.

The illustrated scroll compressor 10 has a mechanical drive 11 in the form of a belt pulley. The belt pulley 11 is connected, in use, to an electric motor or to an internal combustion engine. Alternatively, it is possible that the scroll compressor is driven electrically or electromotively.

The scroll compressor 10 comprises in addition a housing 20 with an upper housing part 21, which closes the high-pressure zone 47 of the scroll compressor 10. In the housing 20 a housing intermediate wall 22 is formed, which delimits a low-pressure chamber 30. The low-pressure chamber 30 can also be designated as suction chamber.

In the housing base 23, a through-opening is formed, through which a drive shaft 12 extends. The shaft end 13, arranged outside the housing 20, is connected in a torque-proof manner to the driver 14, which engages into the belt pulley, mounted rotatably on the housing 20, i.e. into the mechanical drive 11, so that a torque can be transmitted from the belt pulley onto the drive shaft 12.

The drive shaft 12 is rotatably mounted on the one hand in the housing base 23 and on the other hand in the housing intermediate wall 22. The sealing of the drive shaft 12 against the housing base 23 takes place through a first shaft seal 24, and against the housing intermediate wall 22 through a second shaft seal 25.

The scroll compressor 10 comprises furthermore the displacement spiral 31 and a counter spiral 32. The displacement spiral 31 and the counter spiral 32 engage into one another. The counter spiral 32 is preferably fixed both in circumferential direction and also in radial direction. The movable displacement spiral 31, coupled to the drive shaft 12, describes a circular path, so that in a manner known per se, through this movement a plurality of gas pockets or compression chambers 65*a*, 65*b*, 65*c* and 65*d* are produced, which travel radially inwards between the displacement spiral 31 and the counter spiral 32.

Through this orbiting movement, working medium, in particular a refrigerant, is drawn in, and with the further spiral movement and the reduction of the compression chambers 65*a*, 65*b*, 65*c* and 65*d* accompanying this, is compressed. The working medium, in particular the refrigerant, is increasingly compressed for example linearly from radially externally to radially internally, and is expelled into the high-pressure chamber 40 in the centre of the counter spiral 32. In order to generate an orbiting movement of the displacement spiral 31, an eccentric bearing 26 is formed, which is connected to the drive shaft 12 by an eccentric pin. The eccentric bearing 26 and the displacement spiral 31 are arranged eccentrically with respect to the counter spiral 32. The compression chambers 65*a*, 65*b*, 65*c* and 65*d* are separated from one another in a pressure-tight manner by abutment of the displacement spiral 31 and the counter spiral 32.

The high-pressure chamber 40 is downstream of the counter spiral 32 in the direction of flow and is in fluid connection with the counter spiral 32 through an outlet 48. The outlet 48 is preferably not arranged exactly in the midpoint of the counter spiral 32, but rather is situated eccentrically in the region of an innermost compression chamber 65*a*, which is formed between the displacement spiral 31 and the counter spiral 32. Thereby, it is achieved that the outlet 48 is not covered by the bearing bush 28 and the final-compressed working medium can be expelled into the high-pressure chamber 40.

The base 33 of the counter spiral 32 forms in portions the base of the high-pressure chamber 40. The base 33 is wider than the high-pressure chamber 40. The high-pressure chamber 40 is delimited laterally by the side wall 41. At an end of the side wall 41 pointing towards the base 33 of the counter spiral 32 a recess 42 is formed, in which a sealing ring 43 is arranged. The side wall 41 is a circumferential wall, which forms a stop of the counter spiral 32. The high-pressure chamber 40 is formed in the upper housing part 21. This has a rotationally symmetrical cross-section.

The compressed working medium, collected in the high-pressure chamber 40, namely the refrigerant gas, flows through an outlet 44 from the high-pressure chamber 40 into an oil separator 45, which is configured here as a cyclone separator. The compressed working medium, namely the compressed refrigerant gas, flows through the oil separator 45 and the opening 46 into the circuit of the exemplary air-conditioning system.

The control of the contact pressure of the displacement spiral 31 onto the counter spiral 32 is realized in that a base 34 of the displacement spiral 31 is acted upon with a corresponding pressure. For this, a counter pressure chamber 50, which can also be designated as back pressure space, is formed. The eccentric bearing 26 is to be found in the counter pressure chamber 50. The counter pressure chamber 50 is delimited by the base 34 of the displacement spiral 31 and by the housing intermediate wall 22.

The counter pressure chamber 50 is separated from the low-pressure chamber 30 in a fluid-tight manner by the already described second shaft seal 25. A sealing- and slide ring 29 sits in an annular groove in the housing intermediate wall 22. The displacement spiral 31 is therefore supported in axial direction on the sealing- and slide ring 29 and slides thereon.

As can likewise be seen in FIG. 2, the passage 60 of the displacement spiral 31 can produce at least temporarily a fluid connection between the counter pressure chamber 50 and the illustrated compression chamber 65*a*.

The spiral element 66 of the counter spiral 32, in particular the spiral flank portion 67*b*, can temporarily close the passage 60. In other words, the passage 60 is freed by corresponding displacement in relation to the spiral flank portion 67*b*, so that a working medium can flow from the compression chambers 65*a* or 65*b* or 65*c* in the direction of the counter pressure chamber 50.

As is illustrated furthermore in FIG. 2, a gas connection line 70 is formed from the high-pressure zone 47 of the displacement machine or respectively of the scroll compressor 10 to the counter pressure chamber 50. This gas connection line 70 is formed after the oil separator 45, so that actually only gas, and no oil, is transported through the gas connection line 70. A throttle 71 is formed in the gas connection line 70.

In an alternative (not illustrated) configuration of the invention, a gas connection line can be formed in the counter spiral 32. Such a gas connection line can produce a connection from the high-pressure chamber 40 to the counter pressure chamber 50.

It is to be mentioned that no fluid connection is produced from the counter pressure chamber 50 to the low-pressure chamber 30. The mass flow cannot arrive from the counter pressure chamber 50 into the low-pressure chamber 30.

As is furthermore indicated in FIG. 2, an oil return duct 75, with a throttle 76, is formed proceeding from the high-pressure zone 47. Such an oil return duct 75 produces a connection from the high-pressure zone 47 to the low-pressure chamber 30, in order to guarantee the oil return. Therefore, a separate oil return and a separate gas return can be realized.

By means of the scroll compressor according to the invention or respectively by means of the use of the displacement spiral 31 illustrated by way of example in FIG. 1, a variable back pressure system, i.e. a variable counter pressure chamber system, can be constructed. This is founded inter alia on the basis of the arrangement of the passage 60. Various positions of the spirals 31 and 32 with respect to one another occur, depending on the moment in time of the compression process, so that, as is illustrated in FIG. 3, the passage 60 can be free, and a fluid connection is able to be produced from the compression chamber to the counter pressure chamber 50.

Figure 3:
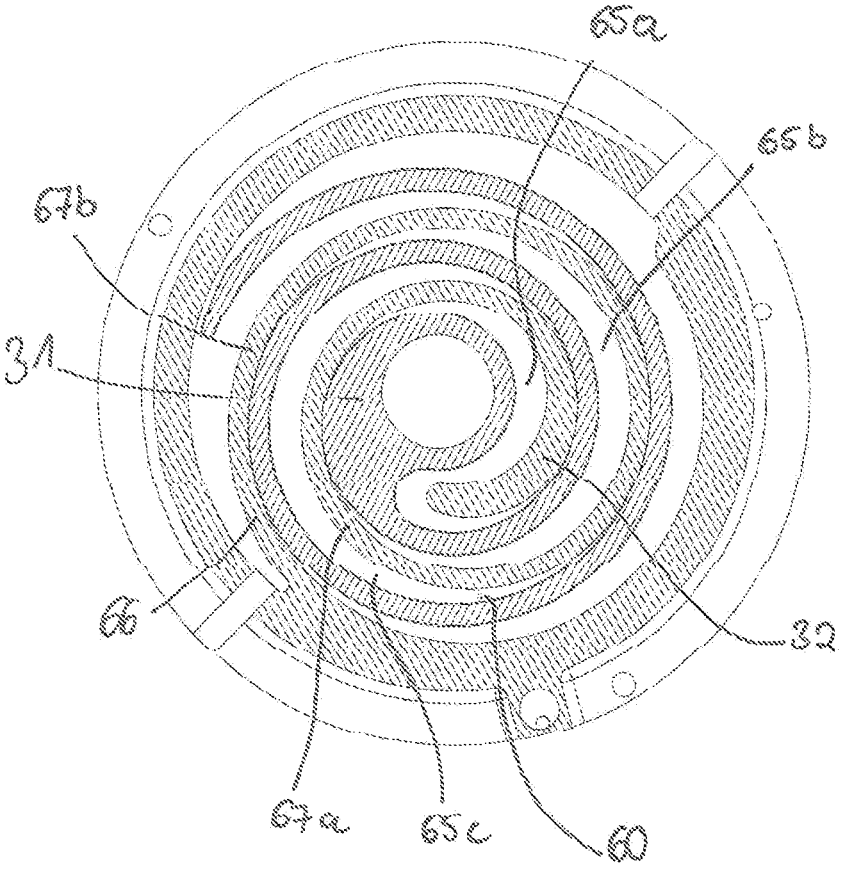
FIG. 3 is a top view onto the displacement spiral, which carries out orbiting movements in the counter spiral, wherein the base of the counter spiral is not illustrated.

In FIG. 3 a view onto the displacement spiral 31 from above is illustrated, wherein the spiral element 66 or respectively the spiral flank portions 67*a*, 67*b* of the counter spiral 32 can be seen. However, the base 33 of the counter spiral 32 can not be seen in FIG. 3.

The passage 60 is not closed, i.e. the spiral element 66 of the counter spiral 32 does not cover the passage 60. Owing to the opening of the passage 60, a fluid connection between the compression chamber 65*c* to the counter pressure chamber 50 is able to be produced.

Figure 4:
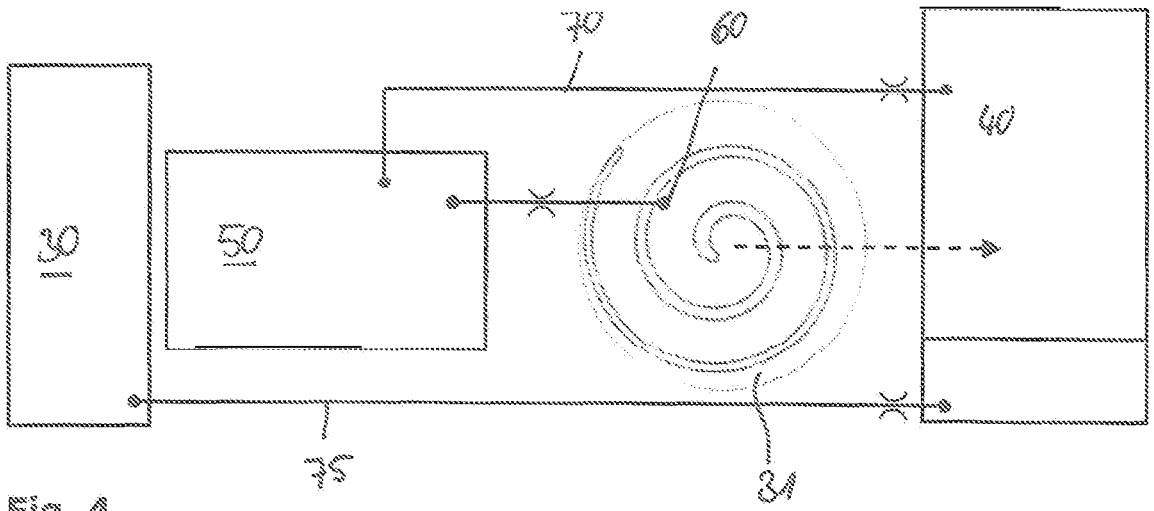
FIG. 4 is a diagrammatic illustration of the operating principle of the displacement machine according to the invention.

In FIG. 4 the basic principle of the displacement machine according to the invention is illustrated diagrammatically. The low-pressure chamber or respectively suction chamber 30, the high-pressure chamber 40 and the counter pressure chamber or respectively the back pressure space 50 can be seen. An oil return duct 75 is formed between the high-pressure chamber 40 and the low-pressure chamber 30. The oil return takes place accordingly exclusively between the high-pressure chamber 40 and the low-pressure chamber 30. Separately therefrom, the gas connection line 70 is formed between the high-pressure chamber 40 and the counter pressure chamber 50. The passage 60 of the displacement spiral 31 can also be seen. Owing to the formed passage 60, a connection is possible from one of the displacement chambers to the counter pressure chamber 50.

Figure 5:
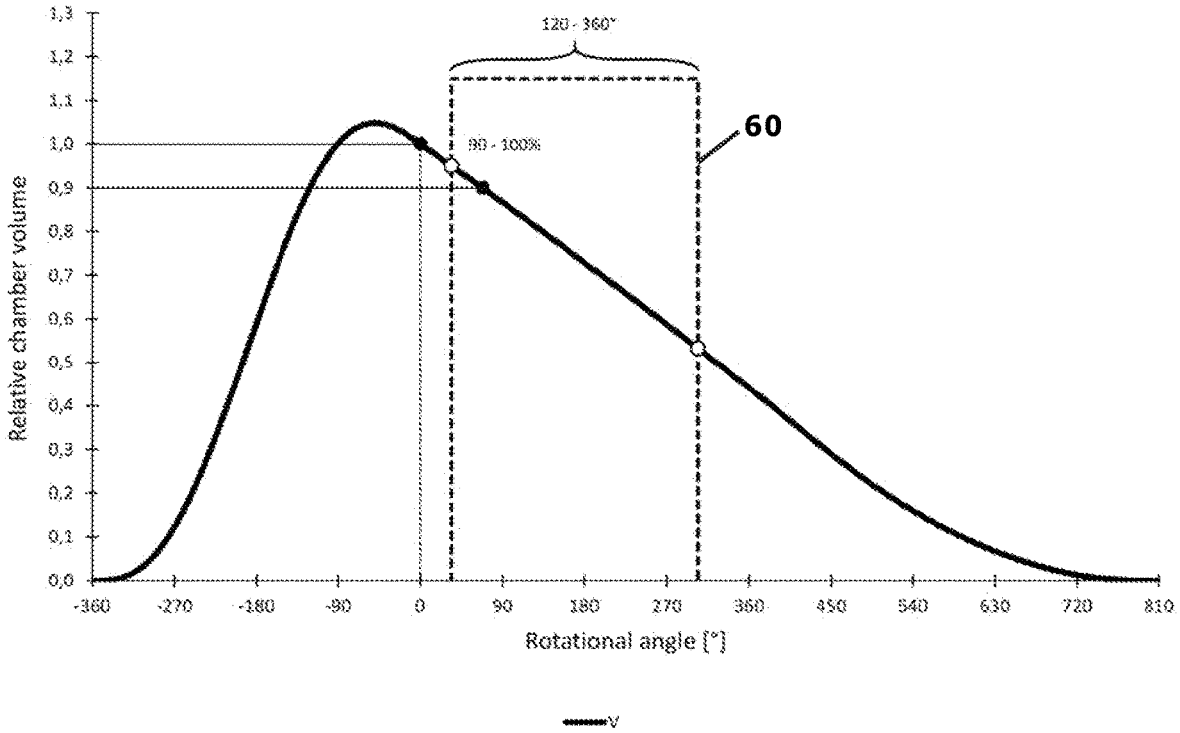
FIG. 5 is an illustration of the opening period of the passage as a function of the rotational angle.

In FIG. 5 a volume change curve of a scroll compressor is illustrated. This volume change curve is basically approximately identical for all scroll compressors and is independent of the refrigerant which is used. The rotational angle 0° shows here the start of the compression process in a scroll compressor. In addition, a dashed graph can be seen, having a substantially rectangular shape. This represents here the moments in time of the compression process at which the passage 60 is opened, depending on the relative volume in the compression chambers (relative chamber volume). It can be seen that the first passage 60 is formed in such a portion, in particular in such a base portion, of the displacement spiral 31, by the passage 60 in activated state of the displacement spiral being opened on reaching of 90%-100%, in particular of 95%, of the relative compression chamber volume, and subsequently, after opening, remaining opened during a following rotation of the displacement spiral 31 about a rotational angle of 120°-360°, in particular about a rotational angle of 270°. In the present case, the passage 60 is opened at a rotational angle of 35°. The closing of the passage 60 takes place, on the other hand, at a rotational angle of 305°.

Figure 6:
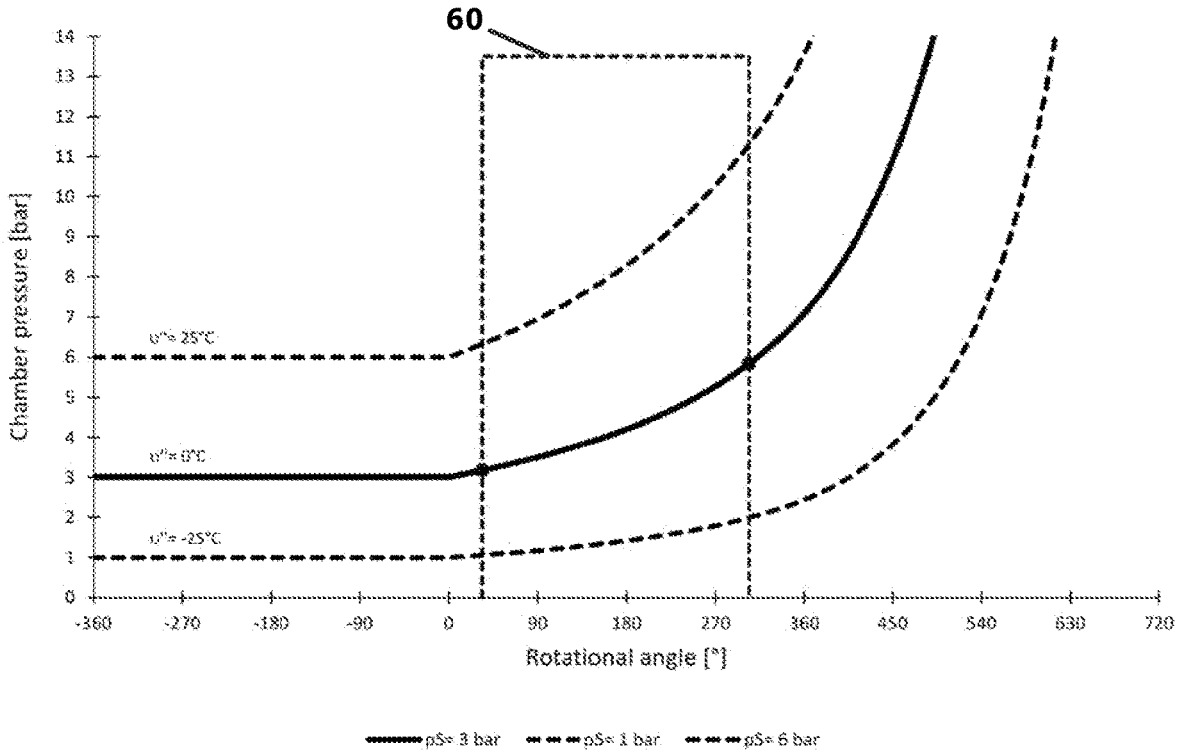
FIG. 6 is an illustration of the pressure in the compression chamber as a function of the rotational angle and of the selected suction pressure in connection with the refrigerant R134a which is used.

In FIG. 6 likewise the opening period of time of the passage 60 is illustrated. The illustration corresponds to a scroll compressor 10, wherein R134a is used as refrigerant. The illustrated graphs are refrigerant-dependent. The graphs are, furthermore, illustrated for different suction pressures (pS) of 1 bar, 3 bar and 6 bar. The behaviour of the pressure in the compression chamber (chamber pressure) can be seen as a function of the rotational angle. With a suction pressure or respectively low pressure of 1 bar, the compression curve runs relatively flat at the opening moment in time of the passage 60, whereas with a suction pressure of 6 bar, the compression curve runs relatively steeply in the respective period of time. The suction pressures 1 bar, 3 bar and 6 bar stand for the respective saturation temperatures/evaporation temperatures u" −25° C., 0° C. and 25° C. A standard scroll compressor must provide corresponding temperatures in vehicle air-conditioning systems in these temperature ranges from −25° C. to +25° C., so that the suction pressure (pS) varies in a range of 1 bar-6 bar.

Figure 7:
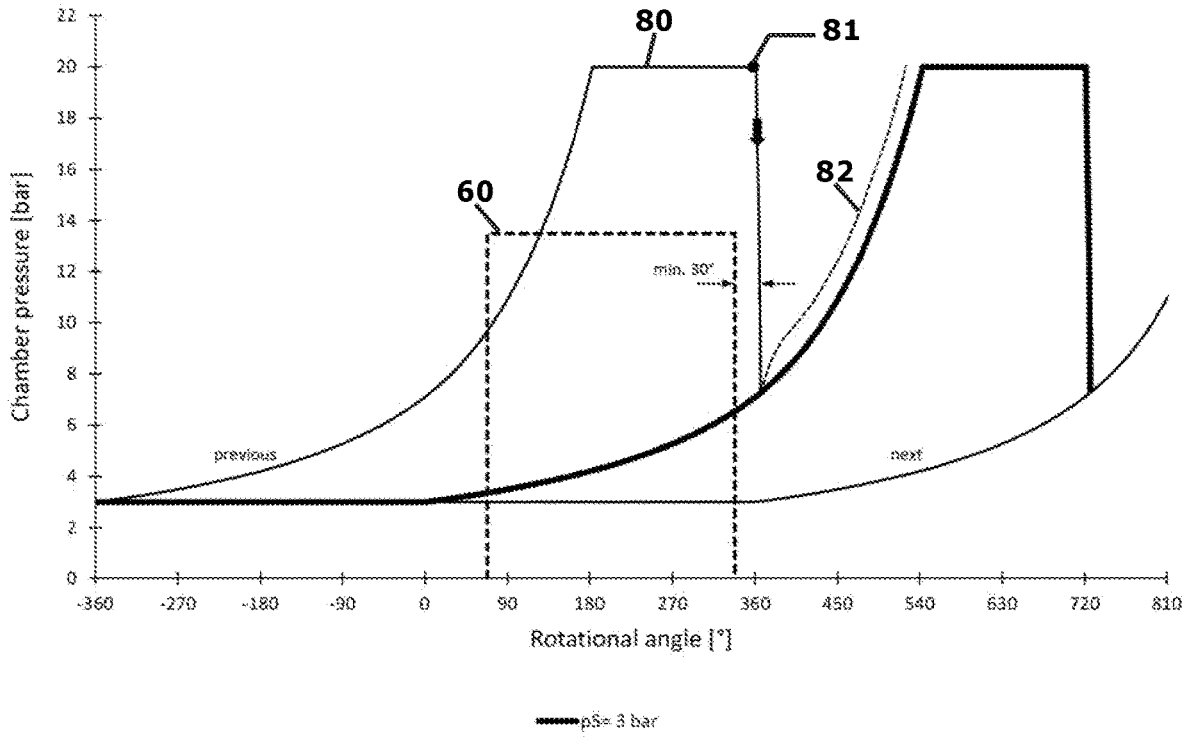

In FIG. 7 again graphs are represented, which illustrate pressures in the compression chamber (chamber pressure) as a function of the rotational angle. The current compression cycle is illustrated here by a thick continuous line. The previous cycle and the next cycle are indicated by thinner lines. With regard to the current compression cycle, in addition the opening duration (dashed line) of the passage 60 is illustrated.

It can be seen that a compression pressure of 20 bar is achieved, wherein the flattened upper part of the graph describes the expulsion limit 80. At this limit 80 the compressed gas is expelled into the high-pressure chamber 40. The expulsion takes place in a rotational angle of approximately 180°-360°. The graph indicates furthermore the so-called discharge angle 81. This discharge angle 81 relates to the moment in time at which the last compressed gas was expelled into the high-pressure chamber and subsequently the pressure in the compression chamber decreases abruptly. The gas compressed in the compression chamber is not expelled completely. A residual gas remains in the compression chamber. However, this must not be expelled into the counter pressure chamber 50, so that the first opening 60 must remain closed before reaching the discharge angle 81. According to FIG. 7, the first passage 60 is to be closed at least 30° before reaching the discharge angle 81.

The area 82, which is formed between the graph of the current compression cycle and a dashed line situated thereabove, represents the residual gas of the previous compression cycle, which was not expelled into the high-pressure chamber.

Figure 8:
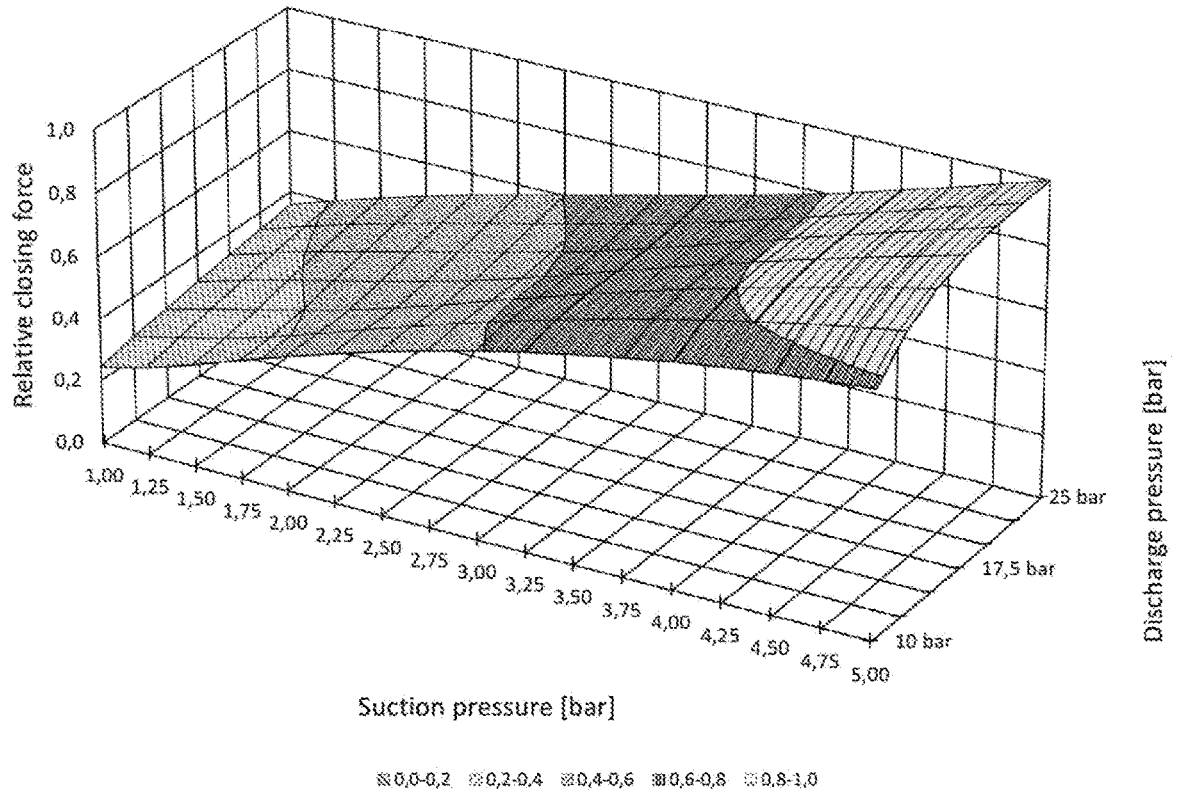
FIG. 8 is an illustration of the closing force in relation to the suction pressure and to the final pressure which is to be achieved.

In FIG. 8 an area is presented which represents the relative closing force concerning the displacement spiral 31 and the counter spiral 32. This is illustrated as a function of the suction pressure and of the final pressure which is to be achieved (discharge pressure). It becomes clear that with increasing final pressure, the closing force must also be increased. The presentation of FIG. 8 relates again to a scroll compressor which is operated with the working medium R134a. In fact, for safety, higher closing forces are generated than are presented in FIG. 8.

LIST OF REFERENCE NUMBERS

10 scroll compressor
11 mechanical drive

12 drive shaft
13 shaft end
14 driver
15 circumferential wall
20 housing
21 upper housing part
22 housing intermediate wall
23 housing base
24 first shaft seal
25 second shaft seal
26 eccentric bearing
28 bearing bush
29 slide ring
30 low-pressure chamber
31 displacement spiral
32 counter spiral
33 counter spiral base
34 displacement spiral base
35 spiral element
36*a*, 36*b* spiral flank portion
37 start region
37*a* opening
38 central portion
39 spiral passage
39*a* end portion
40 high-pressure chamber
41 side wall
42 recess
43 sealing ring
44 outlet
45 oil separator
46 opening
47 high-pressure zone
48 outlet
50 counter pressure chamber
60 passage
65*a*, 65*b*, 65*c*, 65*d* compression chamber
66 spiral element
67*a*, 67*b* spiral flank portion
70 gas connection line
71 throttle
75 oil return duct
76 throttle
80 expulsion limit
81 discharge angle
82 area
M displacement spiral midpoint

What is claimed is:

1. A displacement machine comprising:

a high-pressure zone comprising a high-pressure chamber;

a low-pressure chamber; and an orbiting displacement spiral which engages into a counter spiral such that between the displacement spiral and the counter spiral compression chambers are formed in order to receive a working medium, a counter pressure chamber between the low-pressure chamber and the displacement spiral, only one passage in the displacement spiral, the one passage at least temporarily produces a fluid connection between the counter pressure chamber and at least one of the compression chambers, the passage is formed in such a portion of the displacement spiral in which the passage in an activated state of the displacement machine is opened on reaching of 85%-100% of the relative compression chamber volume, and remains opened during a subsequent rotation, after opening of the passage, of the displacement spiral about a rotational angle of 120°-360° and a gas connection line is formed between the high pressure zone of the displacement machine and the counter pressure chamber and coupled downstream of an oil separator connected to the high pressure zone.

2. The displacement machine according to claim 1, wherein the counter pressure chamber is not fluid-connected with the low-pressure chamber.

3. The displacement machine according to claim 1, wherein the passage is formed in a portion of a base of the displacement spiral.

4. The displacement machine according to claim 1, wherein the passage is closed at least at the rotational angle of 10° before reaching a discharge angle.

5. The displacement machine according to claim 1, wherein the gas connection line is formed in a housing and connects the high-pressure chamber with the counter pressure chamber.

6. The displacement machine according to claim 1, wherein an oil return duct is formed from the high-pressure zone of the displacement machine to the low-pressure chamber.

7. A method for operating a displacement machine according to claim 1, wherein the passage is opened on reaching of 85%-100% of the relative compression chamber volume, and remains opened during a subsequent rotation, after opening, of the displacement spiral about a rotational angle of 120°-360°.

8. The method according to claim 7, wherein a pressure prevailing in the counter chamber is formed owing to a mass flow flowing from the high-pressure zone into the counter chamber and owing to a mass flow flowing from one of the compression chambers into the counter chamber.

9. A vehicle air-conditioning system with a displacement machine, in particular with a scroll compressor, according to claim 1.

10. A vehicle with a displacement machine according to claim 1 and/or with a vehicle air-conditioning system according to claim 9.

* * * * *